US010448757B2

(12) United States Patent
Urban

(10) Patent No.: US 10,448,757 B2
(45) Date of Patent: Oct. 22, 2019

(54) ACCORDION FOLDING DISPLAY HUTCH

(71) Applicant: Sonoco Development, Inc., Hartsville, SC (US)

(72) Inventor: Mark Urban, Villa Hills, KY (US)

(73) Assignee: Sonoco Development, Inc., Hartsville, SC (US)

( * ) Notice: Subject to any disclaimer, the term of this patent is extended or adjusted under 35 U.S.C. 154(b) by 69 days.

(21) Appl. No.: 15/365,108

(22) Filed: Nov. 30, 2016

(65) Prior Publication Data

US 2018/0146803 A1 May 31, 2018

(51) Int. Cl.
*A47F 5/11* (2006.01)
*B65D 5/02* (2006.01)

(52) U.S. Cl.
CPC ..... *A47F 5/116* (2013.01); *A47F 5/112* (2013.01); *B65D 5/0218* (2013.01)

(58) Field of Classification Search
CPC .. A47F 5/116; A47F 5/112; A47F 5/10; A47F 5/11; A47F 5/0018; A47F 5/114; A47B 43/02; A47B 55/06; A47B 47/06; A47B 2220/0019; A47B 43/00; A47B 2220/0086; B65D 71/72; B65D 5/48044; B65D 5/5273; B65D 5/526; B65D 85/325; B65D 5/0218; B65D 5/5007; B65D 5/06; B65D 5/32; B65D 5/4204; B65D 5/0065; B65D 5/009; B65D 5/36
USPC ..... 211/135, 149, 72, 73; 108/165; 206/736, 206/738, 745, 746, 747, 748, 756, 763, 206/769, 772, 774; 229/120.14, 120.15, 229/120.32, 121, 122, 162.1, 162.6, 103, 229/117.01, 120.09, 120.18, 120.21, 104, 229/110; 248/174
See application file for complete search history.

(56) References Cited

U.S. PATENT DOCUMENTS 2,091,291 A * 8/1937 Ringler ..... B65D 5/06 206/388
2,713,984 A * 7/1955 Paige ..... A47F 5/114 211/133.1
2,715,509 A * 8/1955 Paige ..... A47F 5/112 211/126.1
2,745,617 A * 5/1956 Paige ..... A47F 5/114 211/133.1
2,837,264 A * 6/1958 Rous ..... B65D 5/14 229/125.22
3,082,931 A * 3/1963 Greenwell ..... B65D 5/5007 206/418
3,254,826 A * 6/1966 Keith ..... B65D 5/0218 229/101
3,384,222 A * 5/1968 Franco ..... B65D 5/5007 206/277
3,685,775 A 8/1972 Fortunato
(Continued)

*Primary Examiner* — Hiwot E Tefera
(74) *Attorney, Agent, or Firm* — Miller, Matthias & Hull LLP

(57) ABSTRACT

A multiple shelf display hutch is provided that can be made from a single die cut blank. The blank comprises three or more vertical panels separated by vertical fold lines, the number of vertical panels equaling the number of sides of the hutch. The hutch may have three sides, four sides, six sides or any suitable number of sides. The layers/shelves may be vertically arranged so that their sides align vertically or may be offset from each other (rotated horizontally with respect to each other) in what may be referred to as "twisted" configuration.

3 Claims, 15 Drawing Sheets

(56) References Cited

U.S. PATENT DOCUMENTS

| | | | | | |
|---|---|---|---|---|---|
| 3,750,934 | A | * | 8/1973 | Clinage | B65D 5/5007 206/418 |
| 3,973,724 | A | * | 8/1976 | Stone | B65D 5/0218 229/129 |
| 4,392,607 | A | * | 7/1983 | Perkins, Jr. | B65D 5/10 229/109 |
| 4,641,777 | A | * | 2/1987 | Fronduti | B65D 5/32 229/108.1 |
| 4,854,246 | A | * | 8/1989 | Belokin | A47F 5/116 108/162 |
| 5,209,391 | A | * | 5/1993 | Krautsack | B65D 5/0218 229/104 |
| 5,335,593 | A | | 8/1994 | Stoddard et al. | |
| 5,524,789 | A | * | 6/1996 | Jackman | B65D 5/36 215/900 |
| 5,762,262 | A | * | 6/1998 | Martin | B65D 5/36 229/117.01 |
| D627,222 | S | * | 11/2010 | Oravez | D9/432 |
| 8,627,585 | B2 | | 1/2014 | Herman Baran et al. | |

* cited by examiner

ACCORDION FOLDING DISPLAY HUTCH

BACKGROUND OF THE INVENTION

Field of the Invention

This disclosure relates to a display hutch. More particularly, this disclosure relates to a display hutch made from a single die cut blank that can be folded into a three-dimensional column, wherein by pushing down on the column, hinged partial shelf elements automatically fold inward accordion style until they interlock to form shelves.

Description of the Related Art

Floor stands (a.k.a. display hutches) having multiple shelves for supporting products are well known. Typically display hutches are made of multiple components and sometimes even require fasteners. Display hutches can also require complex assembly steps, and can be large even when knocked down. The present disclosure is designed to solve these problems.

BRIEF SUMMARY OF THE INVENTION

The present disclosure relates to a multiple shelf display hutch that can be made from a single die cut blank. The blank comprises three or more vertical panels separated by vertical fold lines, the number of vertical panels equaling the number of sides of the hutch. The hutch may have three sides, four sides, six sides or any suitable number of sides. The layers/shelves may be vertically arranged so that their sides align vertically or may be offset from each other (rotated horizontally with respect to each other) in what may be referred to as "twisted" configuration.

To make the display hutch, the die cut blank is folded along the vertical fold lines into a three-dimensional vertical column. By pushing down on the column, partial shelf panels automatically fold inwardly until they interlock to form the bottoms of the shelves.

In one aspect of the disclosure a blank for making a four sided display hutch comprising four major panels is provided. The four major panels comprise a front panel, a left side panel, a right side panel and a rear panel and are foldably connected along vertical fold lines. Each major panel comprises one or more shelf panels and one or more window panels arranged vertically and separated by horizontal fold lines. Each window panel defines a window. Each shelf panel is divided by a horizontal hinge line into a top portion located above the hinge line and a bottom portion located below the hinge line. Each bottom portion is connected to a horizontal shelf bottom fold line and each top portion is connected to a horizontal shelf top fold line. The top portion has a top portion free edge that extends at an acute angle from the shelf top fold line to an end of the hinge line and the bottom portion has a bottom portion free edge that extends at an acute angle from the shelf bottom fold line to the same end of the hinge line. The hinge line may be horizontal (for a straight sided display hutch) or angled with respect to the horizontal dimension (for a twisted display hutch).

In a second aspect of the disclosure a blank for making a six sided display hutch is provided. The blank comprises six major panels comprising a first panel, a second panel, a third panel, a fourth panel, a fifth panel and a sixth panel foldably connected along vertical fold lines. Each major panel comprises one or more shelf panels and one or more window panels arranged vertically and separated by one or more shelf bottom fold lines and one or more shelf top fold lines. Each window panel defines a full or partial window. Each shelf panel is divided by a hinge line into a top portion located above the hinge line and a bottom portion located below the hinge line. Each top portion is connected to a shelf top fold line and each bottom portion is connected to a shelf bottom fold line. The top portion has a top portion free edge that extends at an acute angle from the shelf top fold line to an end of the hinge line and the bottom portion has a bottom portion free edge that extends at an acute angle from the shelf bottom fold line to the same end of the hinge line. The hinge line may be horizontal (for a straight sided display hutch) or angled with respect to the horizontal dimension (for a twisted display hutch).

In a third aspect of the disclosure a blank for making a three sided display hutch is provided. The blank comprises three major panels comprising a first panel, a second panel and a third panel foldably connected along vertical fold lines. Each major panel comprises one or more shelf panels and one or more window panels arranged vertically and separated by one or more shelf bottom fold lines and one or more shelf top fold lines. Each shelf panel is divided by a hinge line into a top portion located above the hinge line and a bottom portion located below the hinge line. Each top portion is connected to a shelf top fold line and each bottom portion is connected to a shelf bottom fold line. The top portion has a top portion free edge that extends at an acute angle from the shelf top fold line to an end of the hinge line and the bottom portion has a bottom portion free edge that extends at an acute angle from the shelf bottom fold line to the same end of the hinge line. The hinge line may be horizontal (for a straight sided display hutch) or angled with respect to the horizontal dimension (for a twisted display hutch).

DETAILED DESCRIPTION OF THE INVENTION

Figure 1:
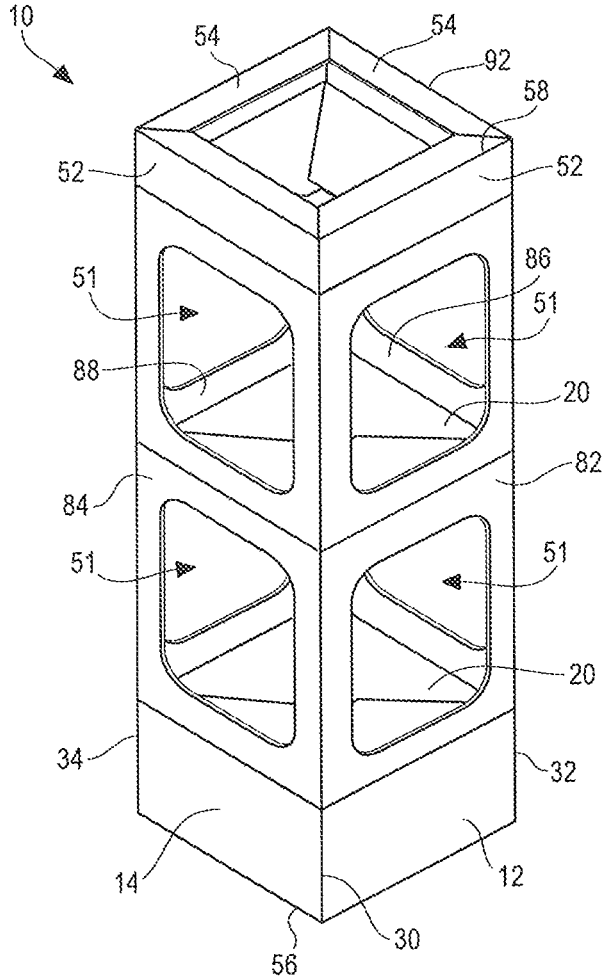
FIG. 1 is a perspective view of a first display hutch according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "horizontal" and "vertical", "above" and "below", "upper" and "lower", "top" and "bottom," "front" and "back," (etc.), used as nouns, adjectives or adverbs refer in this description to the orientation of the structure of the display hutch as it is illustrated in the various views. Such terms are not intended to limit the invention to a particular orientation.

Four Sided Embodiment (Straight Sides)

Turning to the drawings, where like numerals indicate like elements, there is shown in FIG. 1 a perspective view of a display hutch 10 according to the disclosure. The hutch 10 comprises a front panel 12, a left side panel 14, a right side panel 16, a rear panel 18 and one or more shelves 20. Each shelf 20 may have a load bearing surface and corresponds to a level. The hutch 10 may have any number of shelves/levels.

The hutch 10 is a substantially rectilinear, four sided structure and generally extends vertically (bottom to top) from a bottom edge 56 to a top edge 58. The hutch 10 has four vertical corner edges, namely, a left front corner edge 30, a right front corner edge 32, a left rear corner edge 34 and a right rear corner edge 36.

The front panel 12 of the hutch 10 extends laterally from the left front corner edge 30 to the right front corner edge 32. The left side panel 14 extends front to back from the left front corner edge 30 to the left rear corner edge 34. The right side panel 16 extends front to back from the right front corner edge 32 to the right rear corner edge 36. And the rear panel 18 extends laterally from the left rear corner edge 34 to the right rear corner edge 36.

The front panel 12 comprises a front body panel 82 that defines a plurality of openings or windows 51 through which products may be seen and accessed. Likewise, the left side panel 14, the right side panel 16 and the rear panel 18 each may define a plurality of openings or windows 51 through which the products may be seen and accessed. Thus, the display hutch 10 may present four "shoppable" sides, that is, four sides through which products may be seen and accessed.

Each shelf 20 may comprise four separate panels: a front shelf panel 22, a left side shelf panel 24, a right side shelf panel 26 and a rear shelf panel 28. As explained in more detail below, these four shelf panels 22, 24, 26, 28 fold together in accordion fashion to form a shelf 20.

Each of the front panel 12, left side panel 14, right side panel 16 and rear panel 18 may comprise a bottom tab 46, a base panel 48 one or more window panels 50. Each of the front panel 12, left side panel 14, right side panel 16 and rear panel 18 may also comprise a top panel 52 and a top cover panel 54. The top cover panel 54 may be folded inwardly to form a full or partial cover.

Figure 2:
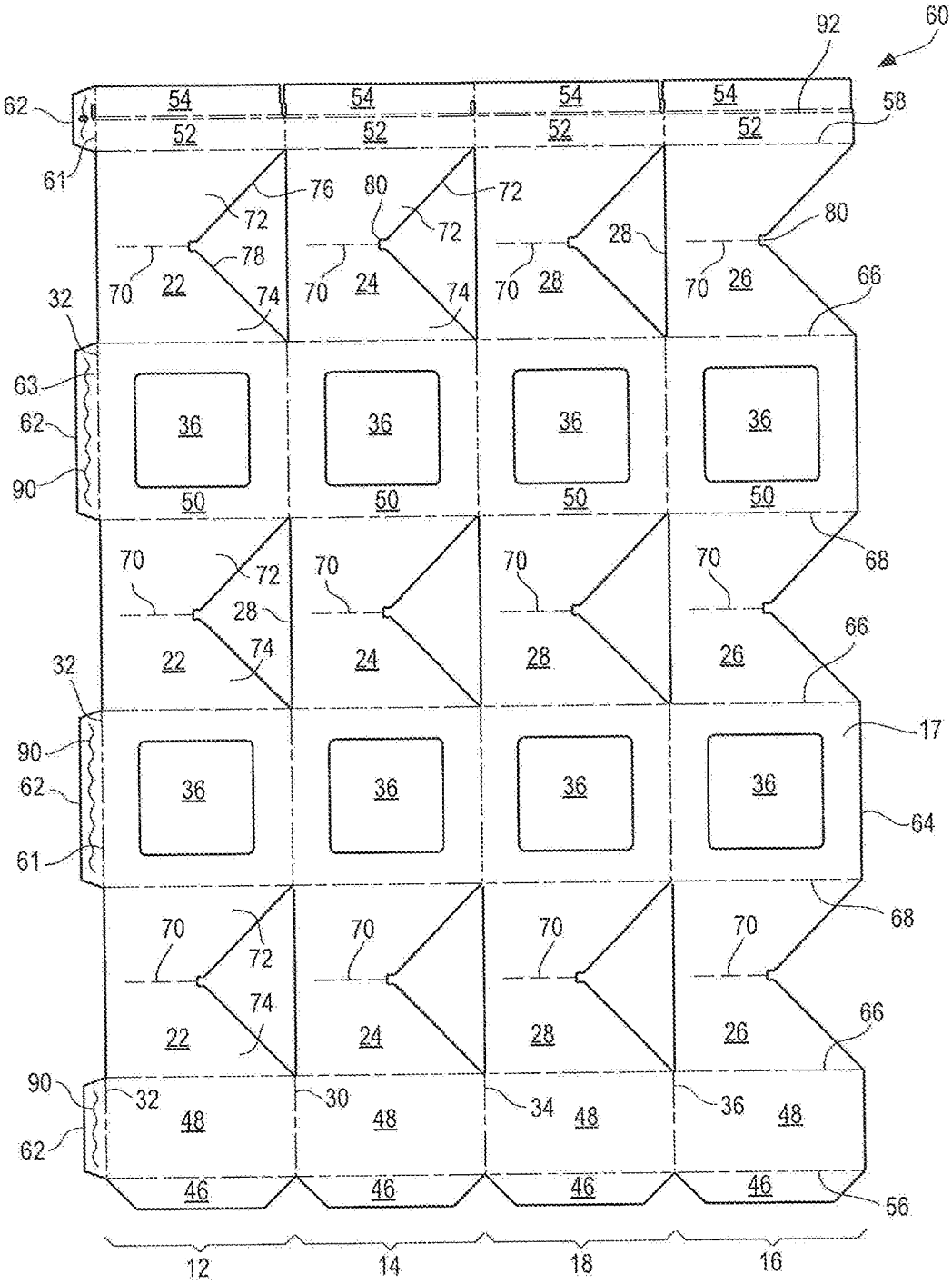
FIG. 2 is a plan view of a blank used to make the display hutch of FIG. 1.

FIG. 2 is a plan view of a blank 60 used to make the display hutch 10 of FIG. 1. The blank 60 comprises four major panels and glue panels 62. The four major panels are, from left to right in FIG. 2, the front panel 12, the left side panel 14, the rear panel 18 and the right side panel 16.

The front panel 12 may be attached to the glue tabs 62 along a second fold line 32 corresponding to the right front corner edge 32 and to the left side panel 14 by a first fold line 30 corresponding to the left front corner edge 30. The left side panel 14 may be attached to the front panel 12 by the first fold line 30 corresponding to the left front corner edge 30 and to the rear panel 18 by a third fold line 34 corresponding to the left rear corner edge 34. The rear panel 18 may be attached to the left side panel 14 along the third fold line 34 and to the right side panel 16 along a fourth fold line 36 corresponding to the right rear corner edge 36. The right side panel 16 may be attached to the rear panel 18 along the fourth fold line 36 and may have a free edge 64.

Of course, other arrangements of the major panels are possible. For example, the glue panels 62 may be foldably attached to the left side panel 14. Or the major panels can be arranged with both side panels 14, 16 foldably attached to the front panel 12. It should be understood that this disclosure is not limited to the particular panel arrangement shown in the drawings.

The front panel 12 comprises a bottom tab 46, a base panel 48, a front body panel 82, a top panel 52 and a top cover panel 54. The front body panel 82 in turn comprises three front shelf panels 22 and two window panels 50. The left side panel 14 comprises a bottom tab 46, a base panel 48, a left side body panel 84, a top panel 52 and a top cover panel 54. The left side body panel 84 in turn comprises three left side shelf panels 24 and two window panels 50. The right side panel 16 comprises a bottom tab 46, a base panel 48, a right side body panel 86, a top panel 52 and a top cover panel 54. The right side body panel 86 in turn comprises three right side shelf panels 26 and two window panels 50. The rear panel 18 comprises a bottom tab 46, a base panel 48, a rear body panel 88, a top panel 52 and a top cover panel 54. The rear body panel 88 in turn comprises three rear shelf panels 28 and two window panels 50.

Each shelf panel 22, 24, 26, 28 may extend vertically from a shelf bottom fold line 66 to a shelf top fold line 68, with the exception of the topmost shelf panels 22, 24, 26, 28, which may extend vertically from a shelf bottom fold line 66 to the top edge 58. Each shelf panel 22, 24, 26, 28 may extend horizontally from a first side to an opposite side. For example, with respect to the front panel 12, each front shelf panel 22 extends from a first side 30 corresponding to the left front corner edge 30 to an opposite side 32 corresponding to the right front corner edge 32.

Each shelf panel 22, 24, 26, 28 may be horizontally bisected in whole or in part by a horizontal hinge line 70, and may comprise a top portion 72 located above the hinge line 70 and a bottom portion 74 located below the hinge line 70. Each top portion 72 and each bottom portion 74 may be any suitable shape, including trapezoidal. The top portion 72 of each shelf panel 22, 24, 26, 28 may be connected to a window panel 50 along a shelf top fold line 68. The top portion 72 may have a free edge 76 extending at an acute angle from the shelf top fold line 68 to an end 80 of the hinge line 70. The bottom portion 74 of each shelf panel 22, 24, 26, 28 may be connected to a window panel 50 along a shelf bottom fold line 66. The bottom portion 74 may have a free edge 78 extending at an acute angle from the shelf bottom fold line 66 to the end 80 of the hinge line 70.

Each window panel 50 extends vertically from a shelf top fold line 68 to a shelf bottom fold line 66 and horizontally from one side to an opposite side. For example, with respect to the front panel 12, each window panel 50 extends from a first side 30 corresponding to the left front corner edge 30 to an opposite side 32 corresponding to the right front corner edge 32. As previously noted, each window panel 50 defines a window 51.

Glue tabs 62 may be attached to the front panel 12 along glue tab fold lines 61. The glue tabs 62 are configured to be adhered to the right side panel 16 as explained below.

Each base panel 48 may be connected to the bottommost partial shelf panel 22, 24, 26, 28 along a shelf bottom fold line 66. Each bottom tab 46 may be hingedly connected to a base panel 48 along a fold line 56 corresponding to the bottom edge 56 of the hutch 10.

Each top panel 52 may be connected to the topmost shelf panel 22, 24, 26, 28 along a fold line 58 corresponding to the top edge 58 of the hutch 10. Each top cover panel 54 may be attached to a top panel 52 along a fold line 92 and may be folded inwardly along the top fold line 92 to cover the top of the hutch 10 in full or in part.

A method of assembling the hutch 10 will now be described with reference to FIGS. 1-7.

First, starting with the blank 60 of FIG. 2, glue or other adhesive 90 may be applied to a surface 63 of each glue panel 62.

Figure 3:
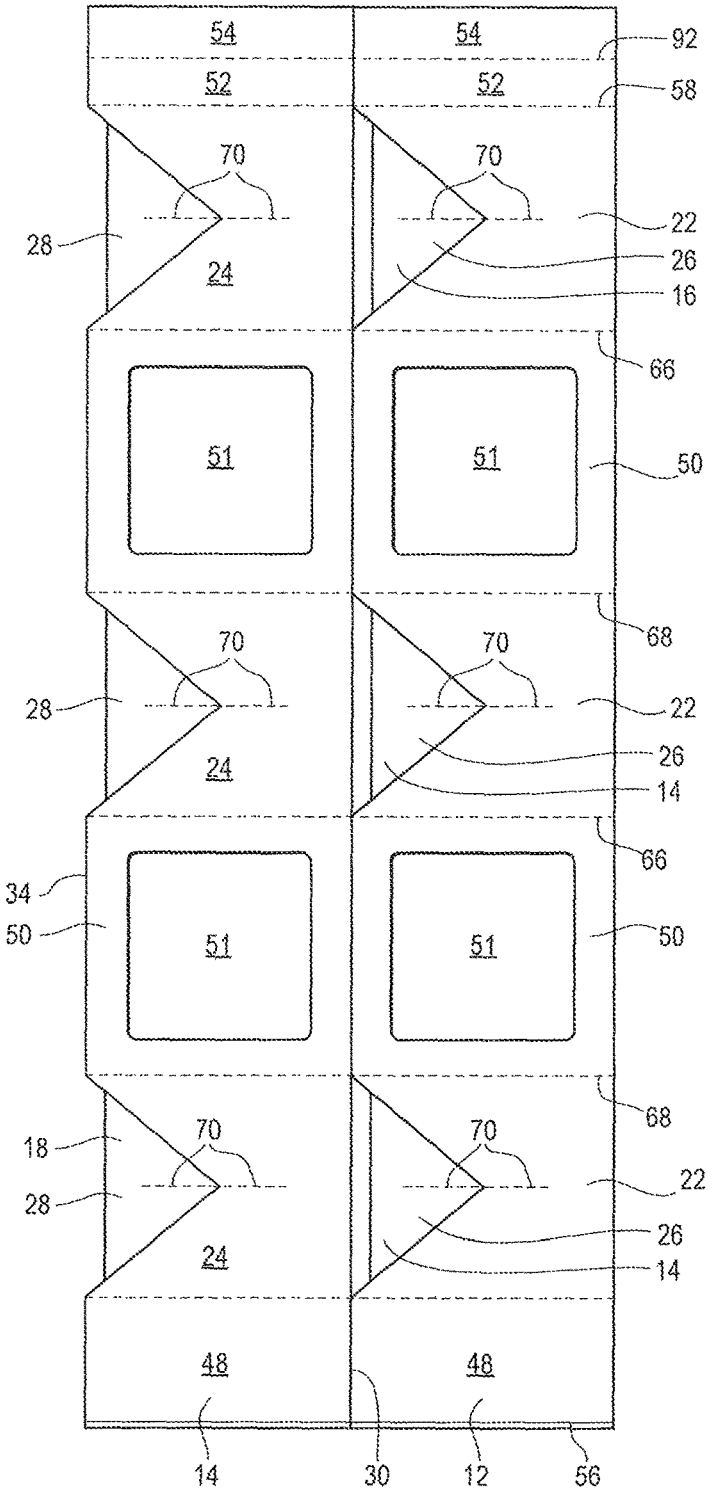
FIG. 3 is a perspective view of the blank of FIG. 2 after being folded and glued.

Next, the blank 60 may be folded in half along the third fold line 34 and the glue tabs 62 adhered to the inner facing surface 17 of the right side panel 16 to form a flat structure like that shown in FIG. 3.

Figure 4:
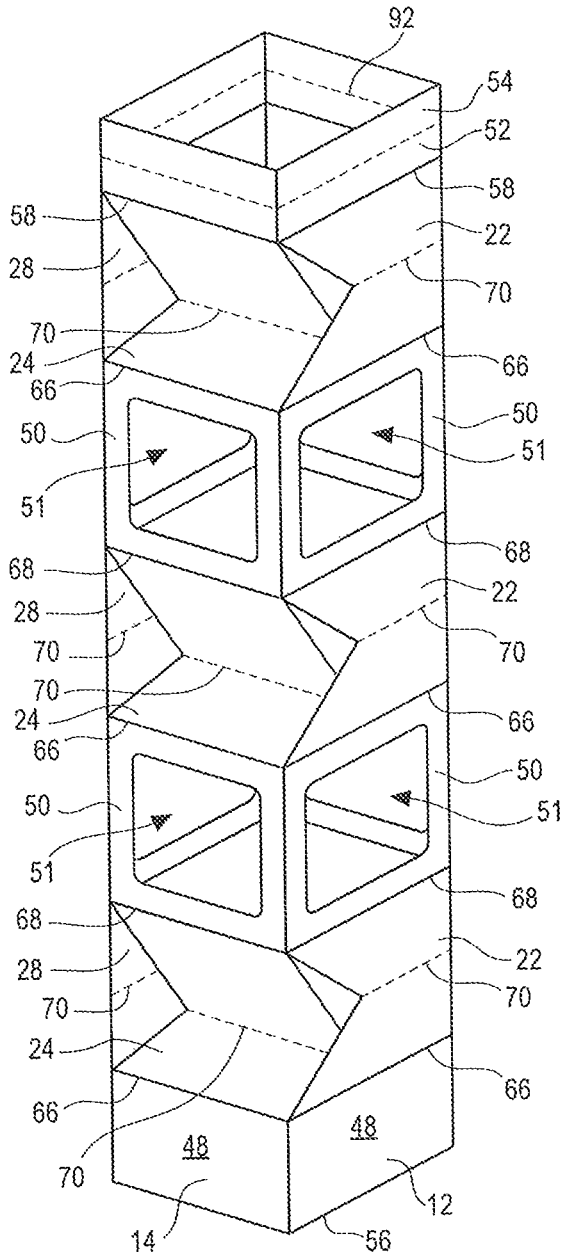
FIG. 4 is a perspective view of the blank of FIG. 3 after being stood upright and opened up.

Next, the folded and glued blank 60 of FIG. 3 may be stood upright with the bottom tabs 46 folded inwardly to help support the blank 60 and squared up (opened up) so that it assumes a three dimensional rectangular column shape like that shown in FIG. 4. The squaring up may be accomplished by pulling outwardly along corner edges 30 and 36.

Figure 5:
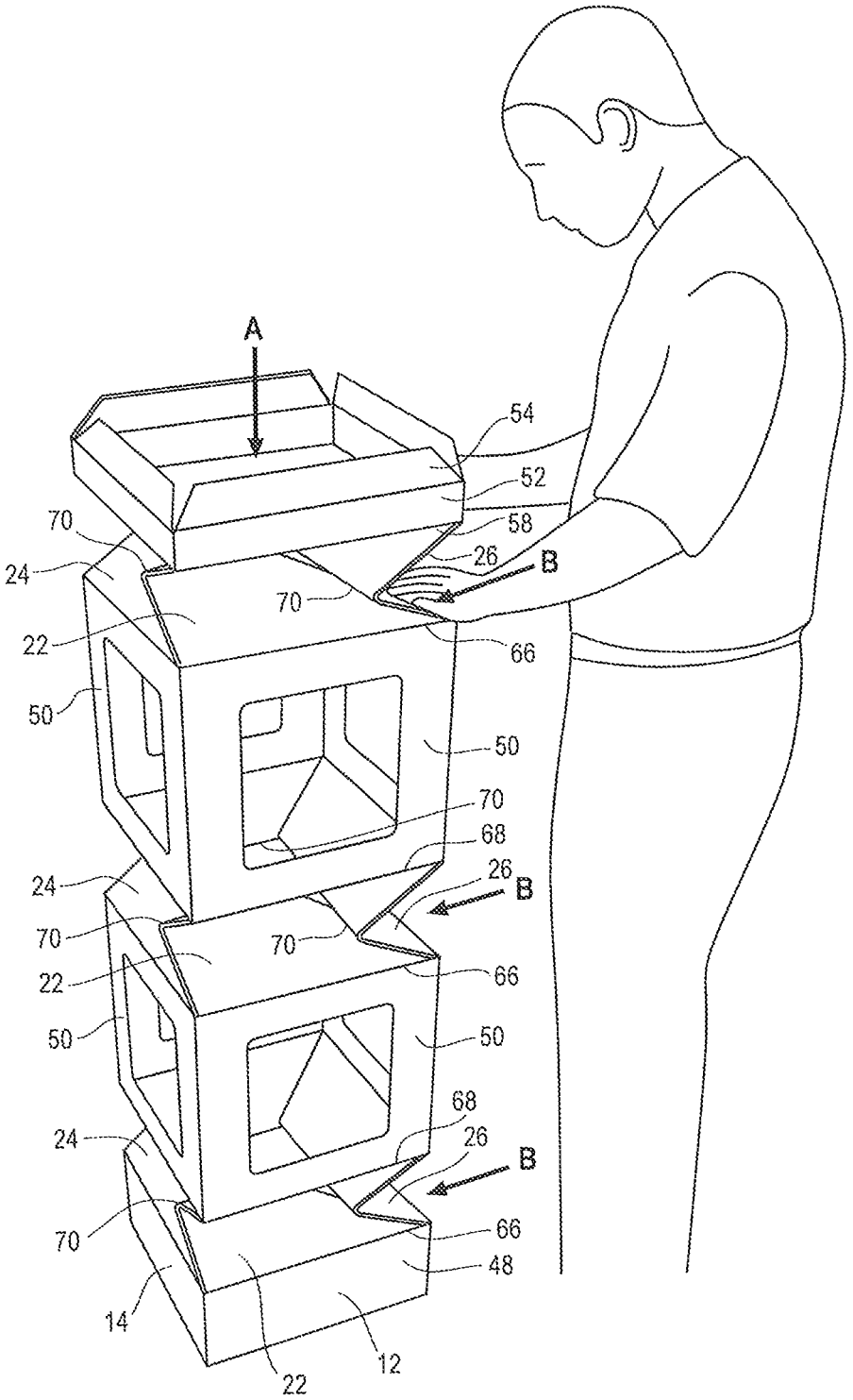
FIG. 5 is a perspective view of the structure of FIG. 4 after being partially pushed down.
Figure 6:
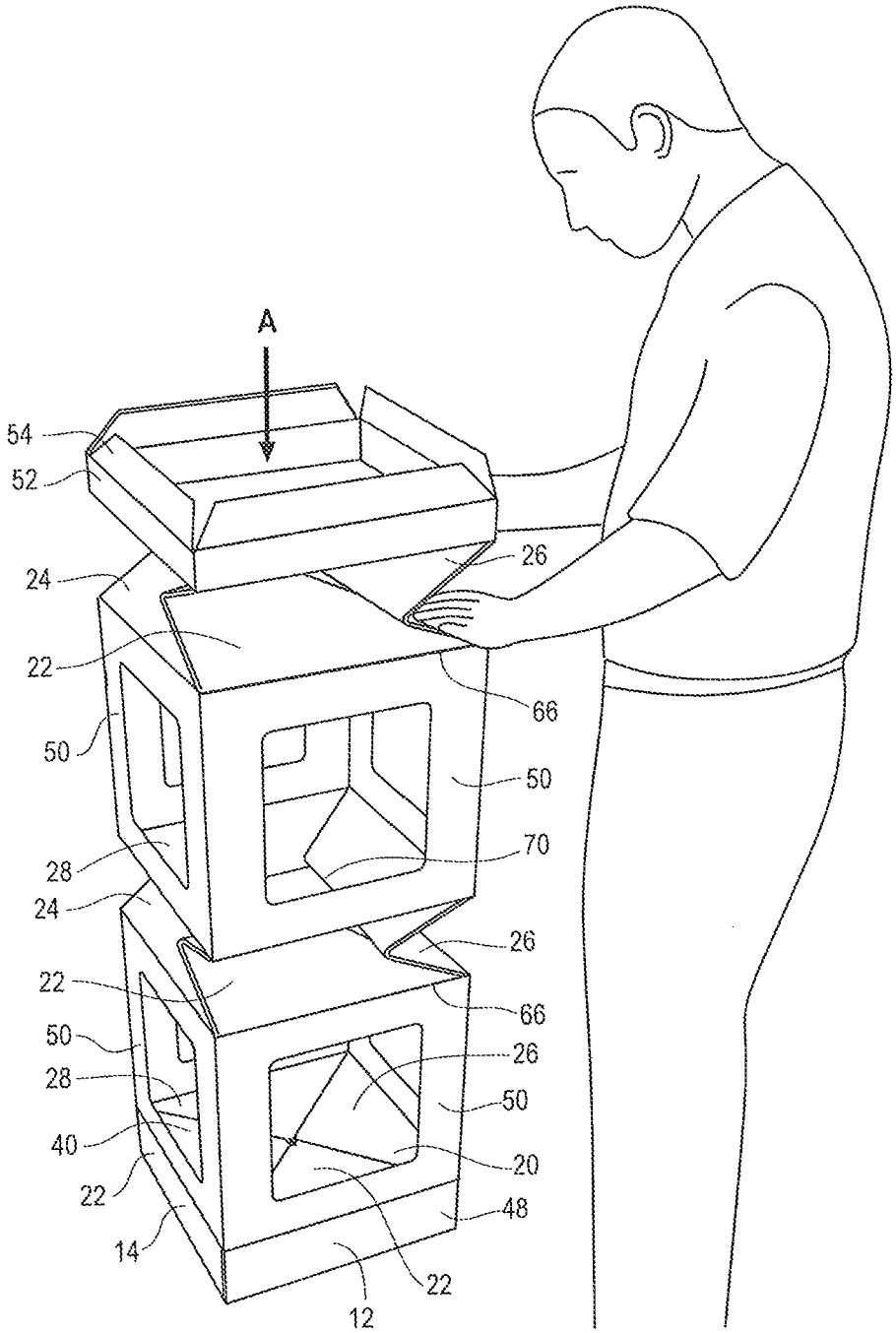
FIG. 6 is a perspective view of the structure of FIG. 5 after being further pushed down.
Figure 7:
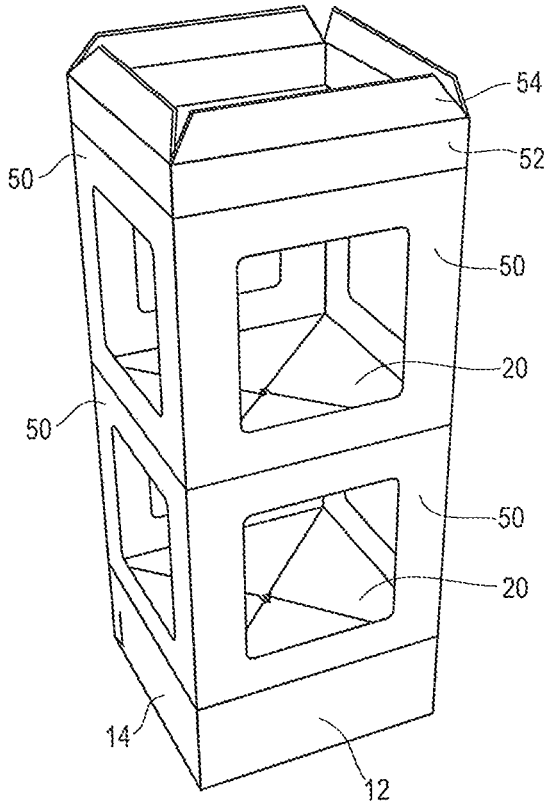
FIG. 7 is a perspective view of the structure of FIG. 6 after being completely pushed down.

Next, an operator can push down on the column in the direction of arrow A as shown in FIGS. 5 and 6, which causes the shelf panels 22, 24, 26, 28 to "automatically" fold inwardly toward each other and interlock to form the shelves 20. Optionally, the an operator also can push inwardly against one or more of the front shelf panel 22, left side shelf panel 24, right side shelf panel 26 or rear shelf panel 28 in the direction of arrow B as shown in FIGS. 5 and 6. The structure may now look like that shown in FIG. 7.

Finally, the top cover may be assembled by folding the top panels an top cover panel inwardly to achieve the finished structure shown in FIG. 1.

Four Sided (Twist) Embodiment

Figure 8:
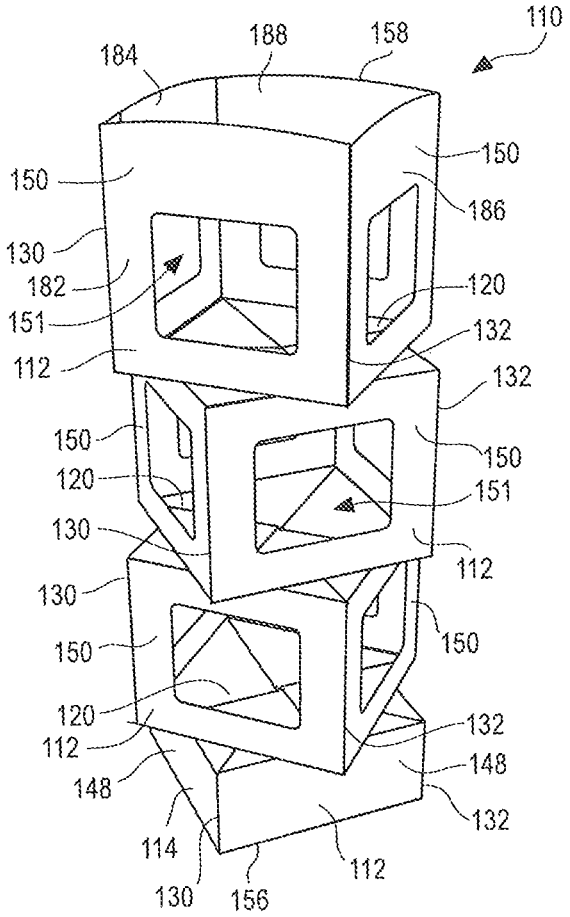
FIG. 8 is a perspective view of another embodiment of a display hutch according to the disclosure.

FIG. 8 is a perspective view of a display hutch 110 according to a second embodiment. The hutch 110 comprises a front panel 112, a left side panel 114, a right side panel 116, a rear panel 118 and one or more shelves 120. Each shelf 120 may have a load bearing surface and corresponds to a level. The hutch 110 may have any number of shelves/levels.

The hutch 110 generally extends vertically (bottom to top) from a bottom edge 156 to a top edge 158, which may be rounded for aesthetic purposes. Unlike the previous embodiment, the finished hutch 110 is not substantially rectilinear with flat sides, but rather one or more levels may be rotated about forty-five degrees with respect to the levels above and below to form the eye-catching display 110 shown in FIG. 8.

The front panel 112 comprises a front body panel 182 that defines a plurality of openings or windows 151 through which products may be seen and accessed. Likewise, the left side panel 114, the right side panel 116 and the rear panel 118 each may define a plurality of openings or windows 151 through which the products may be seen and accessed.

Each shelf 120 may comprise four separate panels: a front shelf panel 122, a left side shelf panel 124, a right side shelf panel 126 and a rear shelf panel 128. As explained in more detail below, these four shelf panels 122, 124, 126, 128 fold and cooperate to form a shelf 120.

Each of the front panel 112, left side panel 114, right side panel 116 and rear panel 118 may comprise a bottom tab 146 (obscured in FIG. 8), a base panel 148 and one or more window panels 150.

Figure 9:
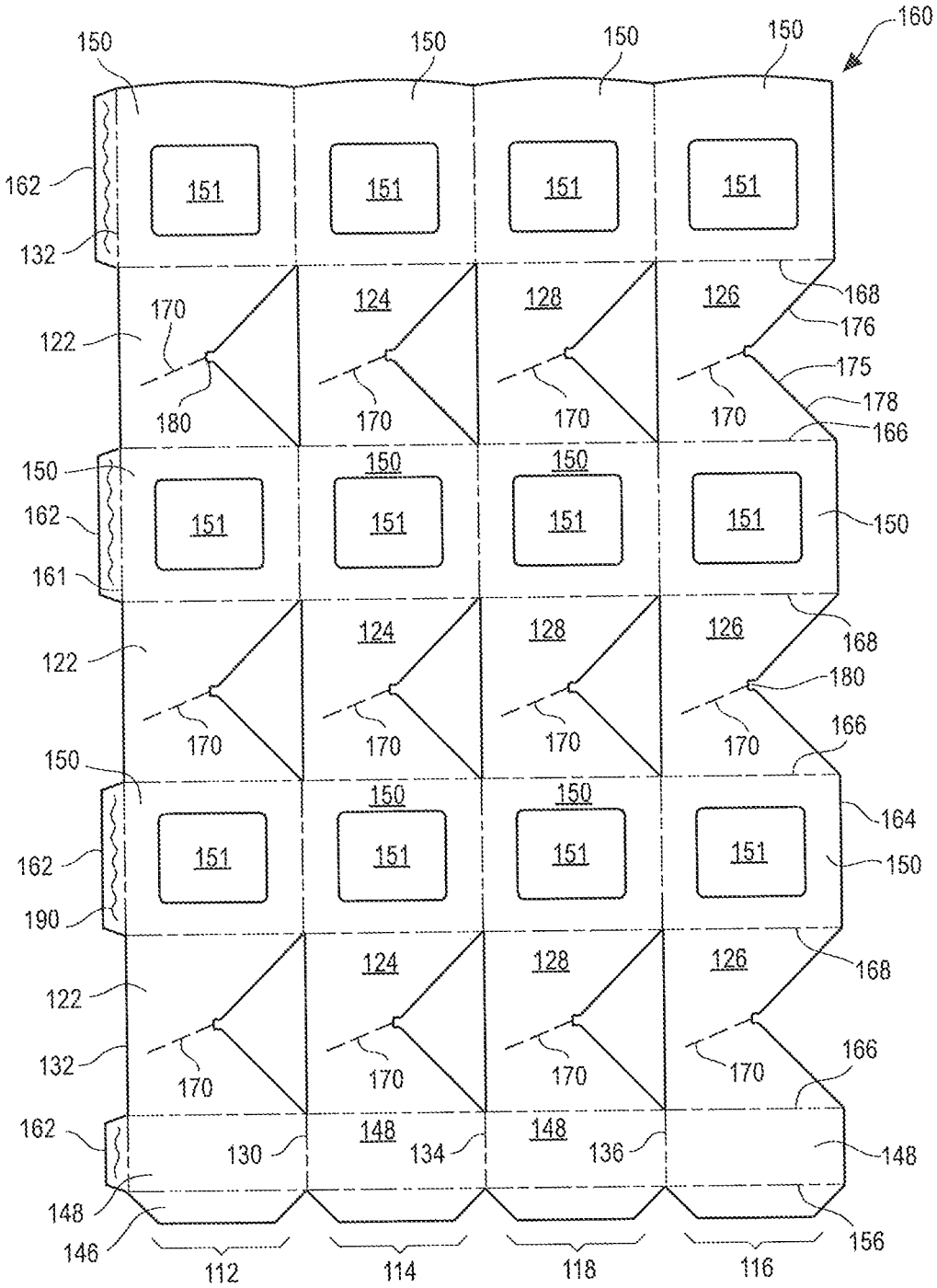
FIG. 9 is a plan view of a blank used to make the display hutch of FIG. 8.

FIG. 9 is a plan view of a blank 160 used to make the display hutch 110 of FIG. 8. The blank 160 comprises four major panels and glue panels 162 separated by fold lines. The four major panels are, from left to right in FIG. 9, the front panel 112, the left side panel 114, the rear panel 118 and the right side panel 116.

The front panel 112 may be attached to the glue tabs 162 along glue tab fold lines 161 and to the left side panel 114 by a first fold line 130. The left side panel 114 may be attached to the front panel 112 by the first fold line 130 and to the rear panel 118 by a third fold line 134. The rear panel 118 may be attached to the left side panel 114 along the third fold line 134 and to the right side panel 116 along a fourth fold line 136. The right side panel 116 may be attached to the rear panel 118 along the fourth fold line 136 and may have a free edge 164.

Of course, other arrangements of the major panels are possible. For example, the glue panels 162 may be foldably attached to the left side panel 114. Or the major panels can be arranged with both side panels 114, 116 foldably attached to the front panel 112. It should be understood that this disclosure is not limited to the particular panel arrangement shown in the drawings.

The front panel 112 comprises a bottom tab 146, a base panel 148 and a front body panel 182. The front body panel 182 in turn comprises three front shelf panels 122 and three window panels 150 in alternating order from bottom to top. The left side panel 114 comprises a bottom tab 146, a base panel 148 and a left side body panel 184. The left side body panel 184 in turn comprises three left side shelf panels 124 and three window panels 150 in alternating order from bottom to top. The right side panel 116 comprises a bottom tab 146, a base panel 148 and a right side body panel 186. The right side body panel 186 in turn comprises three right side shelf panels 126 and three window panels 150 in alternating order from bottom to top. The rear panel 118 comprises a bottom tab 146, a base panel 148 and a rear body panel 188. The rear body panel 188 in turn comprises three rear shelf panels 128 and three window panels 150 in alternating order from bottom to top.

Each shelf panel 122, 124, 126, 128 may extend vertically from a shelf bottom fold line 166 to a shelf top fold line 168. Each shelf panel 122, 124, 126, 128 may extend horizontally from a first side to an opposite side. For example, with respect to the front panel 112, each shelf panel 122 extends from a first side 130 adjacent the left side panel 114 to an opposite side 132.

The top of each shelf panel 122, 124, 126, 128 may be connected to a window panel 150 along a shelf top fold line 168. The bottom of each shelf panel 122, 124, 126, 128 may be connected to a window panel 150 along a shelf bottom fold line 166.

Each shelf panel 122, 124, 126, 128 may be divided into a top portion 172 and a bottom portion 174 by a hinge line 170.

Each shelf panel 122, 124, 126, 128 may have a sideways V-shaped free edge 175 having a top segment 176 extending at an acute included angle from the shelf top fold line 168 to the hinge line 170, and a bottom segment 178 extending at an acute included angle from the shelf bottom fold line 166 to the hinge line 170. The top segment 176 and the bottom segment 178 meet at an end 180 of the hinge line 170.

Unlike in the previous embodiment, the hinge line 170 is not horizontal, that is, parallel to the shelf top fold line 168 and shelf bottom fold line 166, but rather extends from the intersection point 180 at an angle from the horizontal. As described below, this non-horizontal orientation of the hinge line 170 will result in the offset levels shown in FIG. 8.

Each window panel 150 extends vertically from a shelf top fold line 168 to a shelf bottom fold line 166 and horizontally from one side to an opposite side. For example, with respect to the front panel 112, each window panel 150 extends from a first (vertical) fold line 130 to an opposite second (vertical) fold line 132. As previously noted, each window panel 150 defines a window 151.

A glue tab 162 may be attached to each front window panel 150 along a glue tab fold line 132 corresponding to the second fold line 132. The glue tabs 162 are configured to be adhered to the right side panel 116 as explained below.

Each base panel 148 may be connected to the bottommost partial shelf panel 122, 124, 126, 128 along a fold line 166.

A method of assembling the hutch 110 will now be described.

First, starting with the blank 160 of FIG. 9, glue or other adhesive may be applied to a surface 163 of the glue panels 162.

Next, the blank 160 may be folded in half along the second fold line 134 and the glue tabs 162 adhered to the inner facing surface of the right side panel 116 to form a flat structure.

The folded and glued blank 160 may be stood upright with the bottom tabs 146 folded inwardly to help support the blank 160, and then squared up (opened up) so that the blank 160 assumes a three dimensional rectangular column shape. The opening up may be accomplished by pulling outwardly along the first fold line 130 and the third fold line 136.

Next, an operator can push down on the column, which causes the partial shelf panels 122, 124, 126, 128 on each level to "automatically" fold inwardly toward each other and interlock to form a shelf 120. As the structure is pushed downward, the slanted hinge line 170 causes each level to rotate, typically about forty-five degrees. The structure may now look like that shown in FIG. 8, which may be referred to as a "four sided twist" hutch 110.

Six Sided Embodiment

Figure 10:
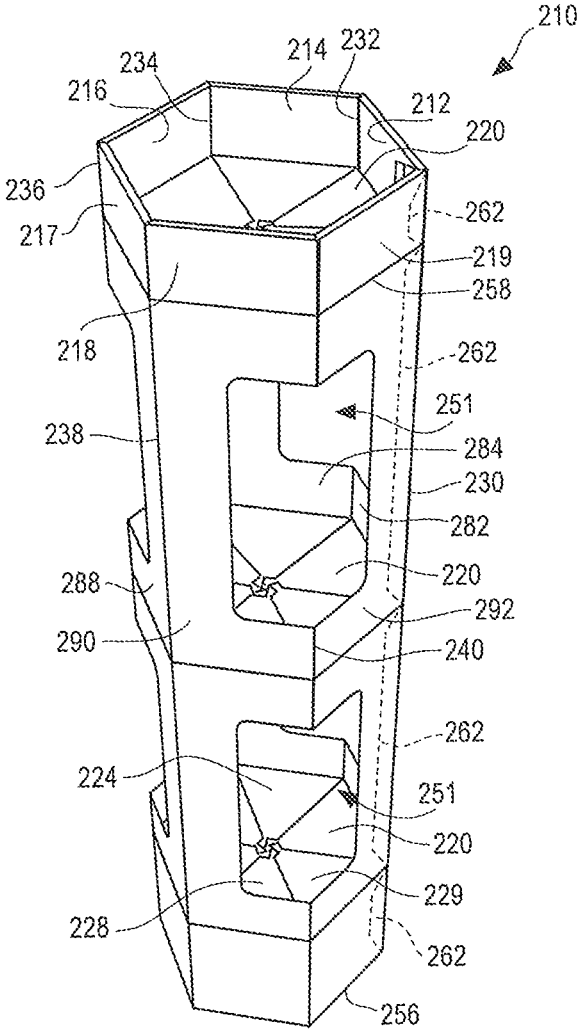
FIG. 10 is a perspective view of another embodiment of a display hutch according to the disclosure.

FIG. 10 is a perspective view of a display hutch 210 according to another embodiment. The hutch 210 is a six sided structure and generally extends vertically (bottom to top) from a bottom edge 256 to a top edge 258.

The hutch 210 comprises six major panels: a first panel 212, a second panel 214, a third panel 216, a fourth panel 217, a fifth panel 218 and a sixth panel 219 and has six vertical corners 230, 232, 234, 236, 238 and 240 and one or more shelves 220. Each shelf 220 may have a load bearing surface and corresponds to a level. The hutch 210 may have any number of shelves/levels.

The first panel 212 comprises a first body panel 282 that defines a plurality of openings or windows 251 through which products may be seen and accessed. Likewise, the second panel 214, third panel 216, fourth panel 217, fifth panel 218 and sixth panel 219 each may define a plurality of openings or windows 251 through which the products may be seen and accessed. The windows 251 may be full, in which each side has a discrete window, or partial, in which adjacent sides share the same window as shown in FIG. 11.

Each shelf 220 may comprise six separate panels: a first shelf panel 222, a second shelf panel 224, a third shelf panel 226, a fourth shelf panel 227, a fifth shelf panel 228 and a sixth shelf panel 229. As explained in more detail below, these six shelf panels 222, 224, 226, 227, 228, 229 fold together in accordion fashion to form a shelf 220.

Each of the first panel 212, second panel 224, third panel 226, fourth panel 217, fifth panel 218 and sixth panel 219 may comprise one or more bottom tabs 246 (obscured in FIG. 10), a base panel 248 and one or more window panels 250. Each of the first panel 212, second panel 224, third panel 226, fourth panel 217, fifth panel 218 and sixth panel 219 may also comprise a top panel 252 and one or more top cover panels 254. The top cover panels 54 may be folded inwardly to form a full or partial cover for the hutch 210.

Figure 11:
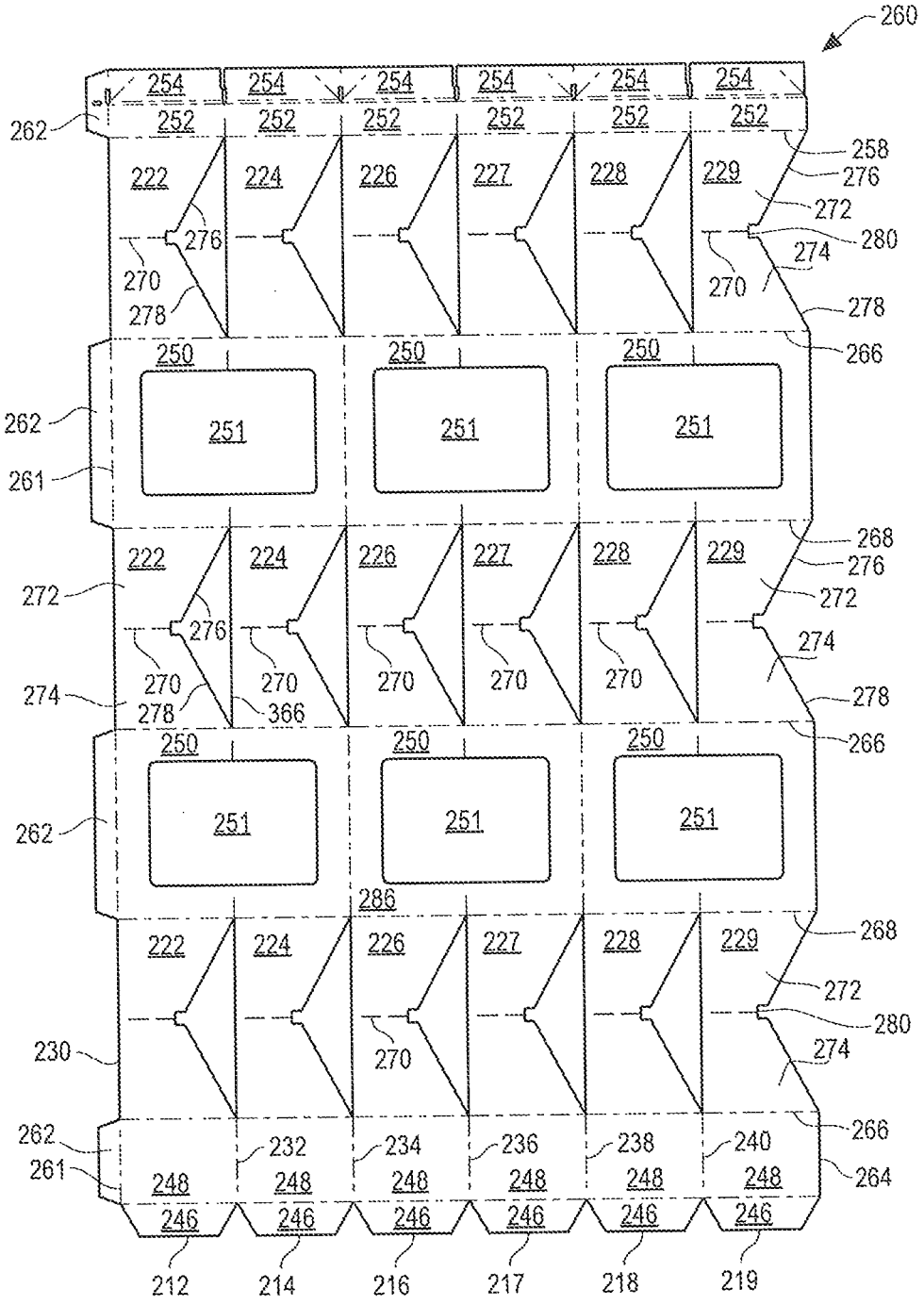
FIG. 11 is a plan view of a blank used to make the display hutch of FIG. 10.

FIG. 11 is a plan view of a blank 260 used to make the display hutch 210 of FIG. 10. The blank 260 comprises six major panels and some glue panels 262. The six major panels are, from left to right in FIG. 11, the first panel 212, the second panel 214, the third panel 216, the fourth panel 217, the fifth panel 218 and the sixth panel 219.

The first panel 212 may be attached to the glue tabs 262 along glue tab fold lines 262 corresponding to the first corner edge 230. The second panel 214 may be attached to the first panel 212 along a second fold line 232 corresponding to the second corner edge 232. The third panel 216 may be attached to the second panel 218 along a third fold line 234 corresponding to the third corner edge 234. The fourth panel 217 may be attached to the third panel 216 along a fourth fold line 236 corresponding to the fourth corner edge 236. The fifth panel 218 may be attached to the fourth panel 217 along a fifth fold line 238 corresponding to the fifth corner edge 238. The sixth panel 219 may be attached to the fifth panel 218 along a sixth fold line 240 corresponding to the sixth corner edge 240 and may have a free edge 264.

Of course, other arrangements of the major panels are possible. For example, the glue panels 262 may be foldably attached to the sixth panel 219. It should be understood that this disclosure is not limited to the particular panel arrangement shown in the drawings.

In the illustrated embodiment the first panel 212 comprises a bottom tab 246, a base panel 248, a first body panel 282, a top panel 252 and a top cover panel 254. The first body panel 282 in turn comprises three first shelf panels 222 and two window panels 250 arranged vertically and separated by shelf bottom fold lines 266 and shelf top fold lines 268.

The second panel 214 comprises a bottom tab 246, a base panel 248, a second body panel 284, a top panel 252 and a top cover panel 254. The second body panel 284 in turn comprises three second shelf panels 224 and two window panels 250 arranged vertically and separated by shelf bottom fold lines 266 and shelf top fold lines 268.

The third panel 216 comprises a bottom tab 246, a base panel 248, a third body panel 286, a top panel 252 and a top cover panel 254. The third body panel 286 in turn comprises three third shelf panels 226 and two window panels 250 arranged vertically and separated by shelf bottom fold lines 266 and shelf top fold lines 268.

The fourth panel 217 comprises a bottom tab 246, a base panel 248, a fourth body panel 288, a top panel 252 and a top cover panel 254. The fourth body panel 288 in turn comprises three fourth shelf panels 227 and two window panels 250 arranged vertically and separated by shelf bottom fold lines 266 and shelf top fold lines 268.

The fifth panel 218 comprises a bottom tab 246, a base panel 248, a fifth body panel 290, a top panel 252 and a top cover panel 254. The fifth body panel 290 in turn comprises three fifth shelf panels 228 and two window panels 250 arranged vertically and separated by shelf bottom fold lines 266 and shelf top fold lines 268.

The sixth panel 219 comprises a bottom tab 246, a base panel 248, a sixth body panel 292, a top panel 252 and a top cover panel 254. The sixth body panel 292 in turn comprises three sixth shelf panels 229 and two window panels 250 arranged vertically and separated by shelf bottom fold lines 266 and shelf top fold lines 268.

Each shelf panel 222, 224, 226, 227, 228, 229 may extend vertically from a shelf bottom fold line 266 to a shelf top fold line 268, with the exception of the topmost shelf panels 222, 224, 226, 227, 228, 229 which may extend vertically from a shelf bottom fold line 266 to the top edge 258. Each shelf panel 222, 224, 226, 227, 228, 229 may extend horizontally from a first side to an opposite side. For example, the first shelf panel 222 extends from a first side corresponding to the first corner edge 230 to an opposite side corresponding to the second fold line 232 or second corner edge 232.

Figure 14:
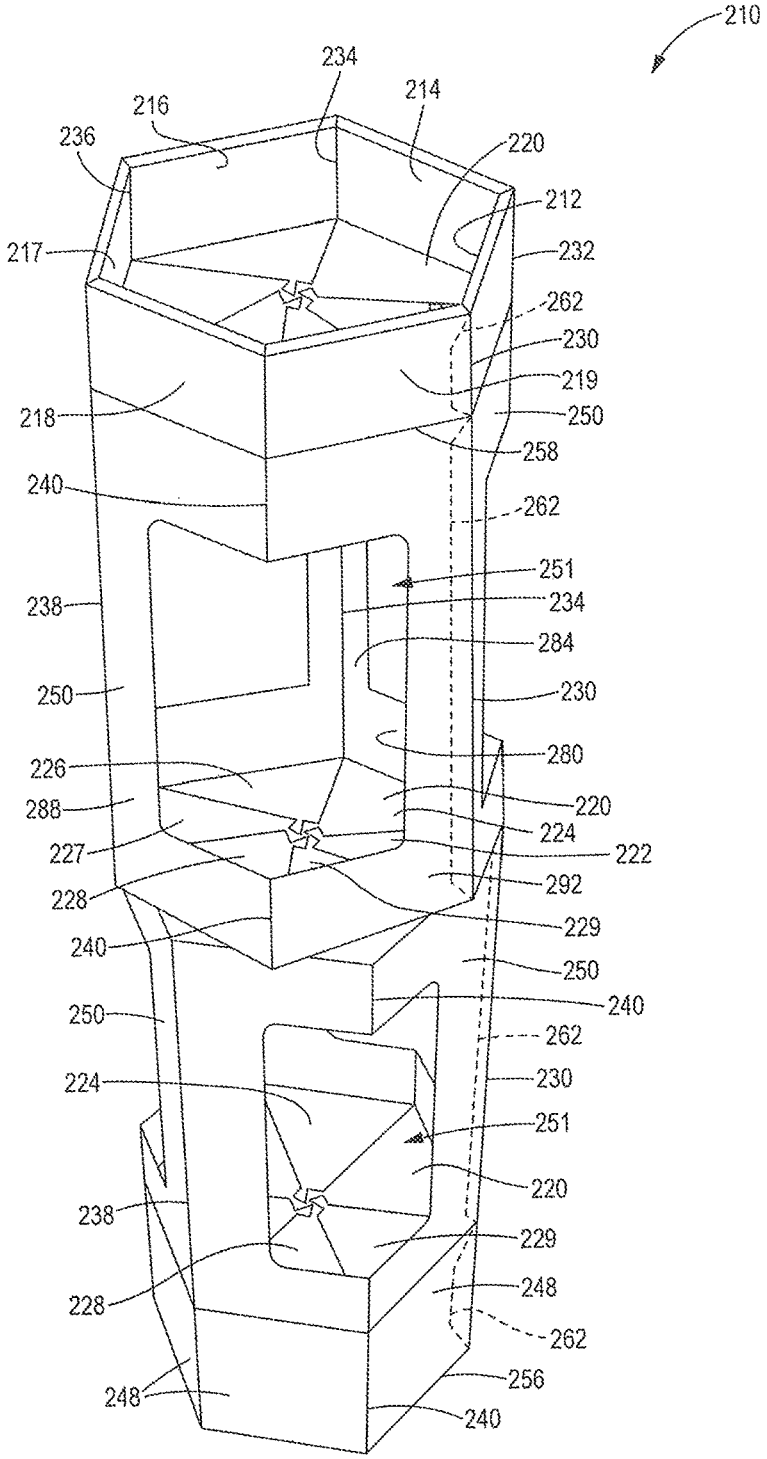
FIG. 14 is a perspective view of another embodiment of a display hutch according to the disclosure.
Figure 15:
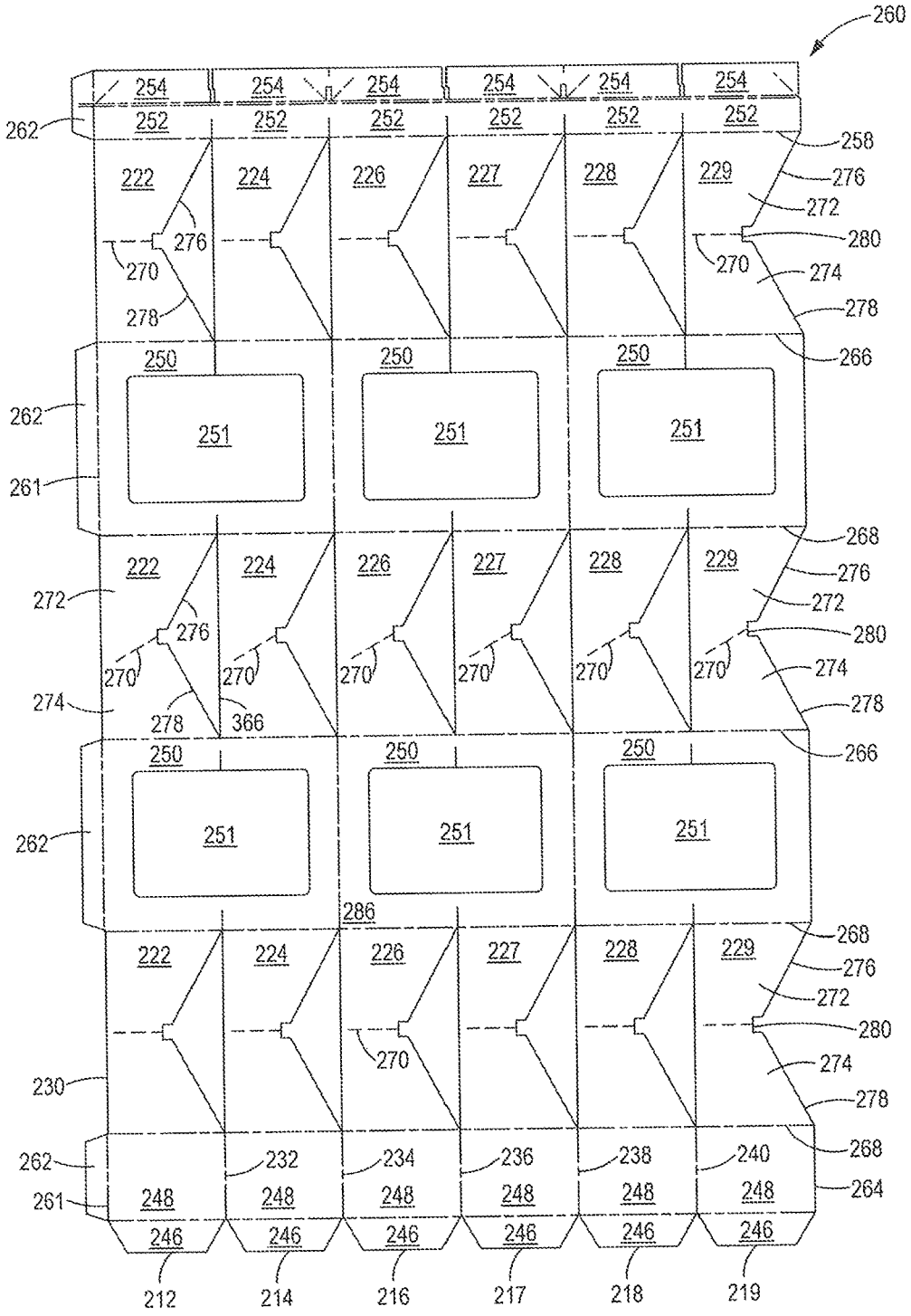
FIG. 15 is a plan view of a blank used to make the display hutch of FIG. 14.

Each shelf panel 222, 224, 226, 227, 228, 229 may be divided by a hinge line 270 into a top portion 272 located above the hinge line 270 and a bottom portion 274 located below the hinge line 270. Each top portion 272 and each bottom portion 274 may be any suitable shape, including trapezoidal. The top portion 272 of each partial shelf panel 222, 224, 226, 227, 228, 229 may be connected to a window panel 250 along a shelf top fold line 268. The top portion 272 may have a free edge 276 extending at an acute angle from the shelf top fold line 268 to an end 280 of the hinge line 270. The bottom portion 274 of each shelf panel 222, 224, 226, 227, 228, 229 may be connected to a window panel 250 along a shelf bottom fold line 266. The bottom portion 274 may have a free edge 278 extending at an acute angle from the shelf bottom fold line 266 to the same end 280 of the hinge line 270. The shelf bottom fold line 266 and the shelf top fold line 268 may define a horizontal dimension. The hinge line 270 may be horizontal (for a straight sided display hutch) or angled with respect to the horizontal dimension (for a twisted display hutch). FIG. 14 is a perspective view of a six sided twisted display hutch 210, and FIG. 15 is a plan view of a blank used to make the six sided twisted display hutch 210 display hutch of FIG. 14.

Each window panel 250 extends vertically from a shelf top fold line 268 to a shelf bottom fold line 266 and horizontally from one side to an opposite side. For example, with respect to the first panel 212, each window panel 250 extends from the first fold line 230 to the second fold line 232. As previously noted, each window panel 250 defines a window 251 or part of a window 251.

Glue tabs 262 may be attached to the first panel 212 along glue tab fold lines 230. The glue tabs 262 are configured to be adhered to the sixth panel 219.

Each base panel 248 may be connected to the bottommost partial shelf panel 222, 224, 226, 227, 228, 229 along a shelf bottom fold line 266.

A method of assembling the hutch 210 will now be described. First, starting with the blank 260 of FIG. 11, glue or other adhesive may be applied to one side of the glue panels 262.

Next, the blank 260 may be folded in half along the fourth fold line 236 and the glue tabs 262 adhered to the sixth panel 219 to form a flat structure.

Next, the folded and glued blank 260 may be stood upright with the bottom tabs 246 folded inwardly to help support the blank 260, and opened up so that it assumes a three dimensional, six sided column shape having a hexagonal horizontal cross section. The opening up may be accomplished by pulling outwardly along corner edges 230, 232, 234, 236, 238 and 240.

Next, an operator can push down on the column, which causes the partial shelf panels 222, 224, 226 227, 228, 229 to fold inwardly toward each other and interlock to form the shelves 220. Optionally, an operator also can push inwardly against one or more of the shelf panels 222, 224, 226, 227, 228, 229 to help form the shelves 220. The structure may now look like that shown in FIG. 10.

Three Sided Embodiment

Figure 12:
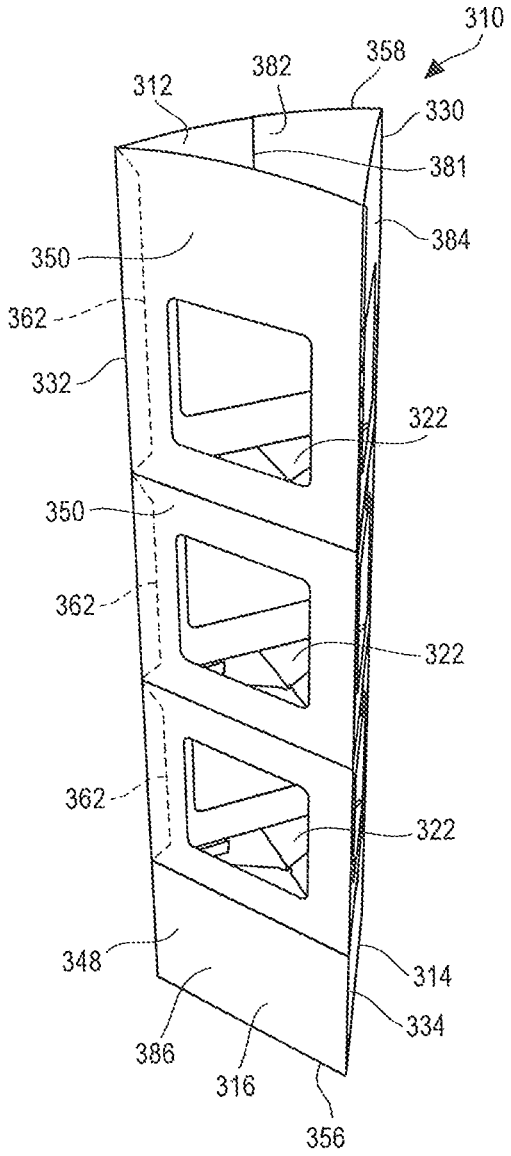
FIG. 12 is a perspective view of another embodiment of a display hutch according to the disclosure.

FIG. 12 is a perspective view of a display hutch 310 according to a third embodiment. The hutch 310 comprises a first panel 312, a second panel 314, a third panel 316 and one or more shelves triangular 320. Each shelf 320 may have a load bearing surface and corresponds to a level. The hutch 310 may have any number of shelves/levels.

The hutch 310 may be thought of as being a three sided structure and generally extends vertically (bottom to top) from a bottom edge 356 to a top edge 358. The hutch 310 has three vertical corner edges, 330, 332, 334.

The first panel 312 of the hutch 310 extends from a first corner edge 330 to a second corner edge 332. The second panel 314 extends from the first corner edge 330 to a third corner edge 334. And the third panel 316 extends from the third corner edge 334 to second corner edge 332.

The first panel 312 comprises a front body panel 382 that defines a plurality of openings or windows 351 through which products may be seen and accessed. Likewise, the second panel 314 and the third panel 316 each may define a plurality of openings or windows 351 through which the products may be seen and accessed.

Each shelf 320 may comprise three separate panels: a first shelf panel 322, a second shelf panel 324 and a third shelf panel 326. As explained in more detail below, on each level these three shelf panels 322, 324, 326 fold together in accordion fashion to form a shelf 320.

Each of the first panel 312, second panel 324 and third panel 326 may comprise one or more bottom tabs 346 (obscured in FIG. 10), a base panel 348 and one or more window panels 250.

FIG. 12 is a plan view of a blank 360 used to make the display hutch 310 of FIG. 10. The blank 360 comprises three major panels and glue panels 362. The three major panels are, from left to right in FIG. 12, the first panel 312, the second panel 314 and the third panel 316.

The first panel 312 may be attached to the glue tabs 362 along a second fold line 332 corresponding to the second corner edge 332 and to the second panel 314 by a first fold line 330 corresponding to the first corner edge 330. The second panel 314 may be attached to the first panel 312 by the first fold line 330 and to the third panel 316 by a third fold line 334 corresponding to the third corner edge 334. The third panel 316 may be attached to the second panel 314 along the third fold line 334 and may have a free edge 364.

Of course, other arrangements of the major panels are possible. For example, the glue panels 362 may be foldably attached to the third panel 316. It should be understood that this disclosure is not limited to the particular panel arrangement shown in the drawings.

In the illustrated embodiment the first panel 312 comprises a bottom tab 346, a base panel 348 and a first body panel 382. The first body panel 382 in turn comprises three first shelf panels 322 and three window panels 350. The second panel 314 comprises a bottom tab 346, a base panel 348 and a second body panel 384. The second body panel 384 in turn comprises three second shelf panels 324 and three window panels 350. The third panel 316 comprises a bottom tab 346, a base panel 348 and a third body panel 386. The third body panel 386 comprises three third shelf panels 326 and three window panels 350.

To enhance foldability, one or more body panels may be bisected by a vertical fold line. For example, in the illustrated embodiment, the first body panel 382 is bisected by a vertical fold line 381.

Each shelf panel 322, 324, 326 may extend vertically from a shelf bottom fold line 366 to a shelf top fold line 368. Each shelf panel 322, 324, 326 may extend horizontally from a first side to an opposite side. For example, with respect to the first panel 312, each first shelf panel 322 extends from a first fold line 330 corresponding to the first corner edge 330 to an opposite side corresponding to the second fold line 332 or second corner edge 332.

Each shelf panel 322, 324, 326 may be horizontally bisected in whole or in part by a horizontal hinge line 370, and may comprise a top portion 372 located above the hinge line 370 and a bottom portion 374 located below the hinge line 370. Each top portion 372 and each bottom portion 374 may be any suitable shape, including trapezoidal. The top portion 372 of each partial shelf panel 322, 324, 326 may be connected to a window panel 350 along a shelf top fold line 368. The top portion 372 may have a free edge 376 extending at an acute angle from the shelf top fold line 368 to the hinge line 370. The bottom portion 374 of each shelf panel 322, 324, 326 may be connected to a window panel 350 along a shelf bottom fold line 366. The bottom portion 374 may have a free edge 378 extending at an acute angle from the shelf bottom fold line 366 to the hinge line 370.

Each window panel 350 extends vertically from a shelf top fold line 368 to a shelf bottom fold line 366 and horizontally from one side to an opposite side. For example, with respect to the first panel 312, each window panel 350 extends from the first fold line 330 to the second fold line 332. As previously noted, each window panel 350 defines a window 351.

Glue tabs 362 may be attached to each front window panel 350 along glue tab fold lines 361. The glue tabs 362 are configured to be adhered to the third panel 316.

Each base panel 348 may be connected to the bottommost partial shelf panel 322, 324, 326 along a shelf bottom fold line 366.

Cut lines 388 formed in the shelf panels 322, 324, 326 create dart tabs 390 that extend downward from the shelf top fold line 368. Corresponding slots 392 may be formed in each shelf panel 322, 324, 326. The slots 392 are co-linear with or adjacent to each shelf bottom fold line 366. When the structure is assembled, the dart tabs 390 fit within the slots 392.

Figure 13:
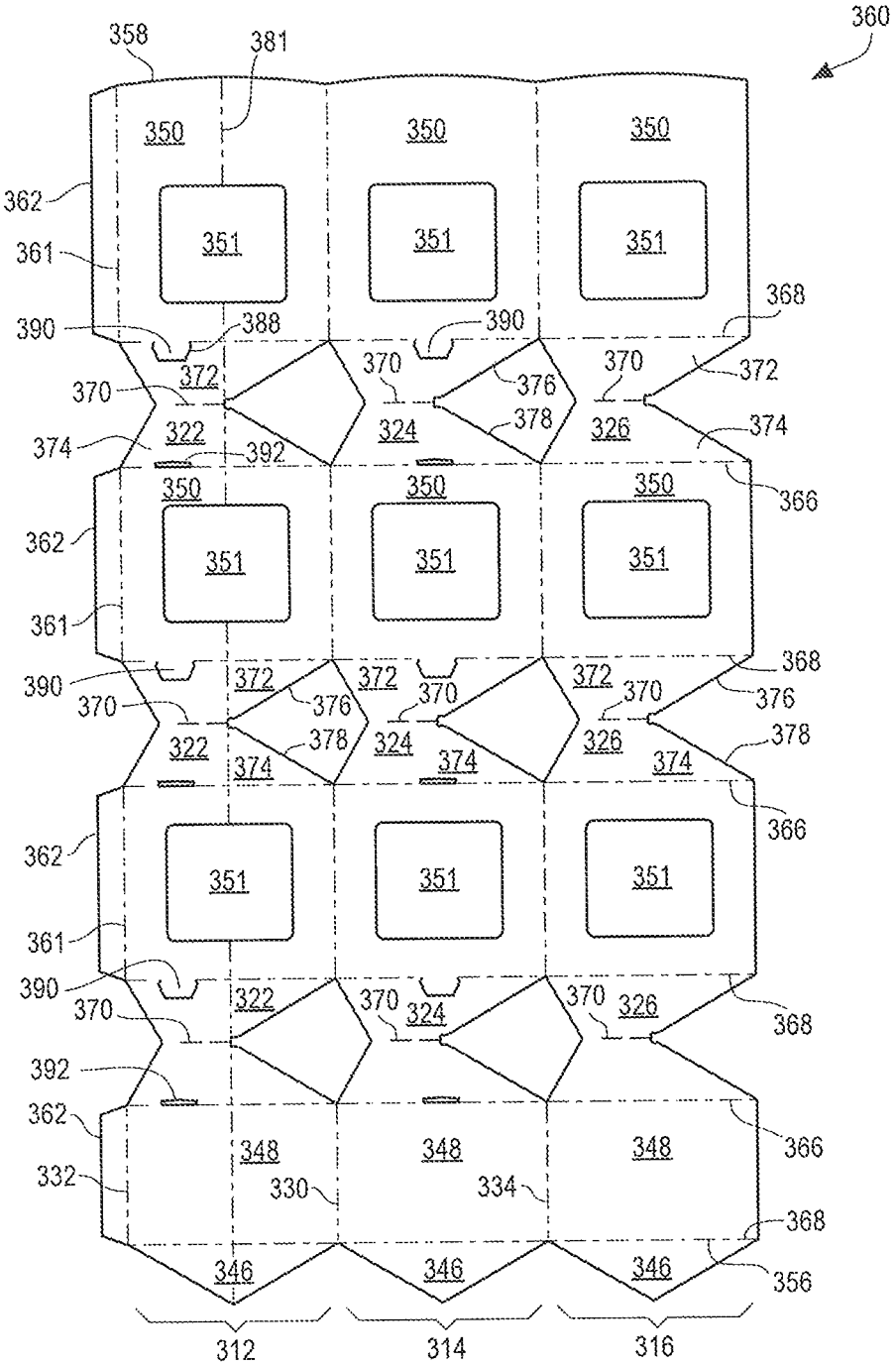
FIG. 13 is a plan view of a blank used to make the display hutch of FIG. 12.

A method of assembling the hutch 310 will now be described. First, starting with the blank 360 of FIG. 13, glue or other adhesive may be applied to one side of the glue panels 362 or to a corresponding area (mating area) of the third panel 316.

Next, the blank 360 may be folded along the first fold line 330 and the third fold line 334 and the glue tabs 362 adhered to the third panel 316 to form a glued structure.

If desired, the glued structure may be made flat by folding the structure along third corner edge 334 and optional fold line 381. This folding will cause the first panel 312 to fold in half and cause the second panel 314 and the third panel 316 to lie in flat abutting relationship to each other. The flat structure has a width about one and half panels. The flat structure may be shipped to the end user in this configuration.

The glued blank 360 may be stood upright with the bottom tabs 346 folded inwardly to help support the blank 360, and opened up so that it assumes a three dimensional, three sided column shape having a triangular horizontal cross section. The opening up may be accomplished by pulling outwardly along the corner edges 330, 334, 336.

Next, an operator can push down on the column, which causes the partial shelf panels 322, 324, 326 to fold inwardly toward each other and interlock to form the shelves 320. Optionally, an operator also can push inwardly against one or more of the shelf panels 322, 324, 326 to help form the shelves 320. As each shelf 320 is formed, the dart tabs 390 fit within the slots 392. The finished structure may now look like that shown in FIG. 12.

INDUSTRIAL APPLICABILITY

The hutch can be used to display any suitable product, in a retail setting or otherwise. The hutch is durable and can bear significant loads, especially if made of corrugated board.

It should be understood that the embodiments described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A six-sided twisted display hutch made from a single blank, the display hutch comprising:

a first display level comprising three pairs of first window panels foldably connected along first vertical corner edges, each pair of first window panels defining a single window opening bisected by one of the first vertical corner edges, the first display level further comprising a first shelf, the first shelf comprising six overlapping first shelf panels;

a second display level comprising three pairs of second window panels foldably connected along second vertical corner edges, each pair of second window panels defining a single window opening bisected by one of the second vertical corner edges, the second display level further comprising a second shelf, the second shelf comprising six overlapping second shelf panels, the second vertical corner edges being offset from the first vertical corner edges; and a base comprising six base panels foldably connected along base vertical corner edges, the base vertical corner edges being vertically aligned with the second vertical corner edges.

2. A six-sided twisted display hutch made from a single blank, the blank comprising:

six major panels foldably connected along vertical fold lines;

each major panel comprising a first window panel, a first shelf panel, a second window panel and a second shelf panel;

the first window panel defining half of a window opening;

the first shelf panel foldably connected to the first window panel along a first horizontal fold line, the first shelf panel divided into a top portion and a bottom portion by a first hinge line, the first hinge line oriented at an angle of greater than zero but less than ninety degrees from the first horizontal fold line;

the second shelf panel foldably connected to the second window panel along a shelf fold line, the second shelf panel divided into a top portion and a bottom portion by a second hinge line, the second hinge line oriented parallel to first horizontal fold line.

3. The six-sided twisted display hutch of claim 2 wherein:

each major panel further comprises a base panel foldably connected to the second shelf panel along a base horizontal fold line.

* * * * *